United States Patent [19]

Kelly

[11] 4,295,642

[45] Oct. 20, 1981

[54] ROLL FED SHINGLING MACHINE WITH PREDETERMINED NUMBERING

[75] Inventor: Robert J. Kelly, Dayton, Ohio

[73] Assignee: The Reynolds and Reynolds Company, Dayton, Ohio

[21] Appl. No.: 84,492

[22] Filed: Oct. 15, 1979

[51] Int. Cl.[3] ..... B65H 39/02; B42B 2/00

[52] U.S. Cl. ..... 270/53; 270/58

[58] Field of Search ..... 270/52–54, 270/58

[56] References Cited

U.S. PATENT DOCUMENTS

| | | | |
|---|---|---|---|
| 2,205,433 | 6/1940 | Paulsen | 270/58 |
| 2,222,983 | 11/1940 | Marcher . | |
| 2,482,613 | 9/1949 | Erickson | 270/52 |
| 2,875,115 | 2/1959 | Dusenbury | 270/58 |
| 3,874,648 | 4/1975 | King | 270/58 |
| 3,901,500 | 8/1975 | Gath | 270/53 |
| 4,118,022 | 10/1978 | Rayfield | 270/52.5 |
| 4,147,338 | 4/1979 | Gath | 270/53 |

OTHER PUBLICATIONS

European Patent Application #79300735.2, Filed 4-3-0-79.

*Primary Examiner*—Edgar S. Burr
*Assistant Examiner*—A. Heinz
*Attorney, Agent, or Firm*—Biebel, French & Nauman

[57] ABSTRACT

A unitary shingling apparatus prepares uniformly shingled sets of forms from a continuous, preprinted roll. The apparatus numbers the individual forms in groups of predetermined count, wherein the forms in each group receive identical numbers. Each group is then shingled into its own set. The forms are numbered while still on the web, then separated from the web by a reciprocating knife, transported individually to a predetermined indexing position, and then transferred, glued and shingled onto a shingling conveyor in the shingled, overlapped sets.

11 Claims, 7 Drawing Figures

ROLL FED SHINGLING MACHINE WITH PREDETERMINED NUMBERING

BACKGROUND OF THE INVENTION

This invention relates to machines for assembling and fastening forms in shingled sets, and more particularly to a machine which is especially adapted for rapidly and continuously numbering, assembling, and fastening forms from a continuous web thereof into shingled sets of predetermined count. The forms in each set are numbered with related, usually identical numbers, while the number printed on the forms in one set differs from that on any other set.

Such shingled sets of forms, often called "controlled" sets, are becoming increasingly popular. The positive numbering of the forms provides for precise control and accounting for every form which is issued. For example, such sets are used in hospitals in connection with controlled substances such as narcotics. A certain initial quantity of the substance may be "assigned" to a given set of the forms (for instance 20 forms), and each time a dose of the substance is administered, a precise record is entered on one of the forms in the set. The shingled forms are usually attached to the front of a large receipt or control ledger onto which the information entered on the individual sheets or forms is copied. Further, that initial quantity of the controlled substance, and the corresponding particular controlled set of forms, become the responsibility of one individual (for example, a particular nurse). Thus "phantom" forms, perhaps stolen from a supply room, cannot be used to obtain unauthorized material because the forms are numbered and identifiable.

In prior art shingling machines, the individual forms are commonly supplied in stacks of discrete sheets which have been pre-numbered in groups of predetermined count. The forms in each group have identical numbers so that they can be shingled into corresponding sets as described. The stacks are prepared in several phases, each of which requires operator intervention, thereby interrupting the continuity of the preparation thereof. For example, a printing press may typically be equipped with a sheeter to separate the individual forms from the continuous web as it comes out of the printing press. The stacks of individual sheets are then transferred to another machine where they are numbered in their groups and re-stacked. These in turn are transferred to and fed into a sheet shingling machine.

It might be thought that the forms could be directly numbered on the printing press itself. Prior experience, however, has shown that as a practical matter this is mechanically too difficult. It is true that consecutive numbering is commonly done in which each form is numbered one higher than the last. This is an entirely different matter, however, from numbering the forms in groups in which the forms in each group receive identical or related numbers.

Known numbering presses which number consecutively have press speeds, for example, of 500 feet per minute, which is substantially slower than presses which do not require printing this variable information. Every time such a press is started, there are potential registration problems between the fixed information and the printing of the variable (number) information. Further, every time one roll is spliced to another (which is usually done while the press continues operating at or near full speed), a form must be rejected due to the splice therein. Also, the individual rolls themselves commonly have one or two mill splices in them, leading to additional rejected forms.

These problems are serious enough on presses which number consecutively. In the preparation of controlled sets, in which exact numbers of splice-free forms must be provided, it is impractical to try to number these forms on the initial printing press. The frequent interruptions and restarting which would be occassioned by the splices would be intolerable. Not unimportant, also, is the lack of numbering equipment which can satisfactorily advance intermittently (for example, once every twenty forms) at these press speeds.

A need therefore remains for a method and apparatus compatible with continuous full speed operation of printing presses for the production of controlled sets of shingled forms. Preferably, such a method and apparatus will allow the individual forms as they first come from the printing press to be rewound onto a roll at full speed, as a continuous web, rather than requiring the web of forms to be fed more slowly directly into a sheeter. Then, in a single operation, these rolls should be transferable to a machine which, in a unitary apparatus, will number and process the forms into the shingled, overlapped, controlled sets.

SUMMARY OF THE INVENTION

Briefly, the present invention meets the above needs with a unitary apparatus for numbering and shingling forms from a continuous preprinted web, so that the forms may first be conveniently printed at high speed and wound directly onto a roll. The present invention then makes it possible to remove the roll of preprinted forms from the press, and in a single subsequent operation, to number the forms in groups of predetermined count, in which the forms in each group have related, preferably identical numbers, separate the numbered forms individually from the web, and fasten the separated forms in each group into shingled, overlapped sets.

More specifically, the present invention mounts a reel of the continuous, preprinted forms, unwinds the web from the reel, and advances it intermittently to a numbering station. Registration of the forms is maintained by advancing the forms on pin wheels which engage in line holes along the side of the web. The numbering station includes an impression printer which is reciprocated against the forms, when they are stopped, to print a predetermined number thereon. The number which is printed is advanced periodically and regularly, after printing the same number on each of the forms in each group, to print the next consecutive number on the forms in the next group, and so on.

After each reciprocation of the printer, the web is advanced to a knife for severing the individual forms from the web. The web is then stopped, and the numbering mechanism and knife are simultaneously reciprocated downwardly to number the next form and to separate a previously numbered form. The knife and numbering mechanism are then withdrawn and the web again advanced. Just prior to cutting and separating the numbered forms individually from the web, side slitters on both sides of the web trim it to a narrower, predetermined width and remove the line holes therefrom.

The separated forms are each received from the knife onto a transport conveyor which advances them to a vacuum transport conveyor located thereover. The vacuum transport conveyor, which uses vacuum to hold the forms on the underside thereof, continues to advance the forms to a vertically reciprocating shift plate. The vacuum transport conveyor and vertically reciprocating shift plate provide for advancing each form directly to a location where the shift plate deposits them onto a reciprocating slide. The shift plate is actually several plates which, when reciprocated downwardly, move between and through the belts of the vacuum transport conveyor to press the forms individually downwardly away therefrom, break them free from the vacuum, and deposit them directly onto the reciprocating slide.

The reciprocating slide is operably movable back and forth between a position adjacent a "shifting location", in which the shift plate presses the form thereinto, and an indexing position to which the reciprocating slide then advances the form. In the indexing position each form is individually precisely located in an exact, predetermined position above a shingling conveyor. Side and front joggers assure that the form will be properly positioned against register stops which define the indexing position. A vacuum indexing elevator, which serves as a transfer means, engages and holds the form in the indexing position as the slide returns to receive another form. After the slide has cleared the indexing elevator, the elevator lowers and deposits it on the shingling conveyor. Due to the indexing of the individual forms in the predetermined indexing position, the shingled sets can be accurately developed without having to retain the line holes thereon. As the form is deposited on the shingling conveyor, an adhesive is simultaneously applied to the form, as needed, to fasten it to the forms already on (or subsequently to be deposited upon) the shingling conveyor. The shingling conveyor is then incrementally advanced for receiving the next form, thereby causing the forms to be shingled in a regular, partially overlapped relation thereon. The shingling conveyor is also a vacuum conveyor to hold the forms firmly in position, thereby assuring regular and uniform development of the shingled sets of forms on the conveyor during the advancing thereof. Operation of the gluer is appropriately inhibited at the completion of each shingled set, to separate the forms in one group from those in the next.

It is therefore an object of the present invention to provide an improved unitary apparatus for processing and shingling a continuous web of preprinted forms into numbered, controlled sets; an apparatus which process the forms by numbering the forms in groups of predetermined count of at least two forms each, giving the forms in each group related numbers, numbering the forms in consecutive groups, consecutively, separating the numbered forms individually from the web, and fastening the separated forms of each group into shingled, overlapped sets; which prepare the controlled sets of shingled forms with minimum operator intervention; in which the final controlled sets are accurately shingled without requiring line holes; in which a vacuum transport conveyor and reciprocating slide may be used to transport the forms to a predetermined indexing position from which they can be accurately transferred onto a shingling conveyor for precisely and accurately developing the shingled sets thereon; and to accomplish the above objects and purposes in an uncomplicated, versatile and reliable configuration which is readily adapted to the convenient and rapid processing of a wide variety of forms into controlled shingled sets.

Other objects and advantages of the invention will be apparent from the following description, the accompanying drawings and the appended claims.

DESCRIPTION OF THE PREFERRED EMBODIMENT

Figure 1:
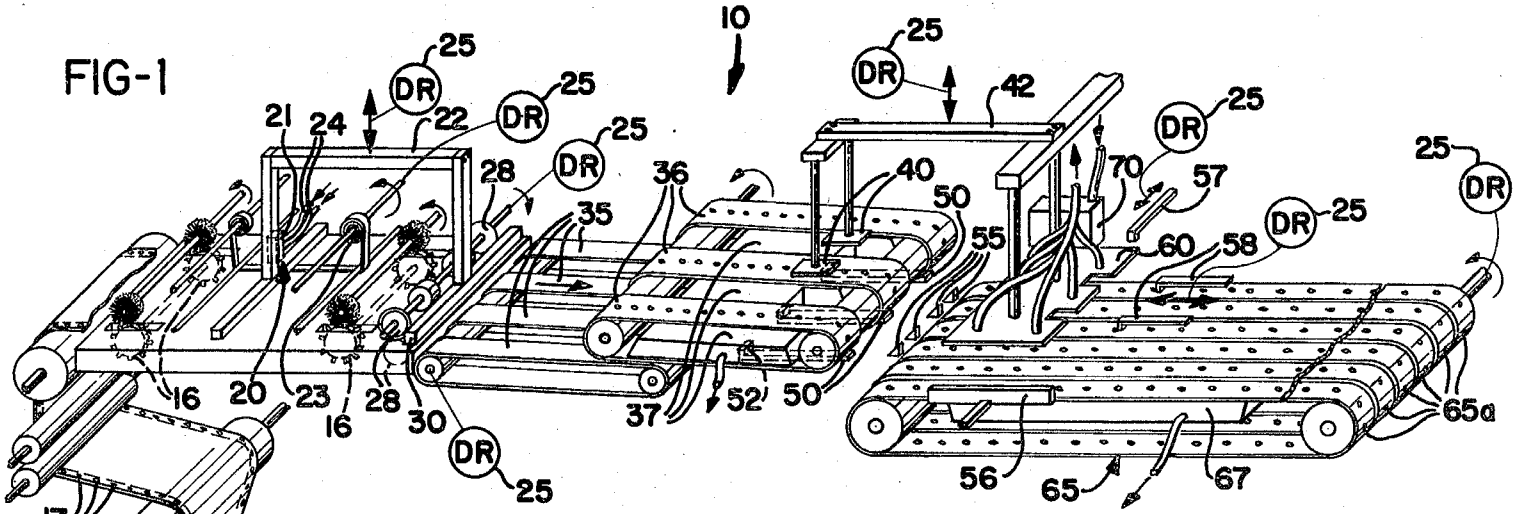
FIG. 1 is a somewhat diagrammatic perspective view of the shingling apparatus showing the relationship of the principal elements to one another.
Figure 3:
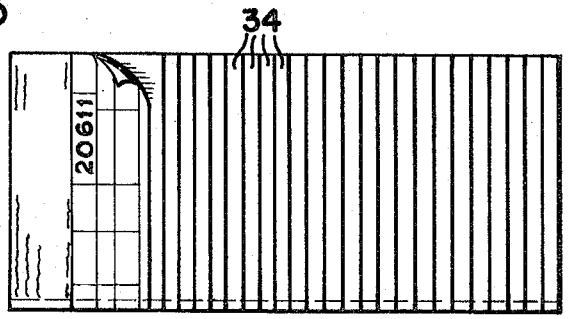
FIG. 3 illustrates a completed set of shingled, overlapped forms.

FIG. 1 shows a roll fed shingling apparatus 10 having a spindle 12 on which is supported a roll 13 of preprinted forms. The web 14 of preprinted forms which is unwound from roll 13 is unwound from the roll and advanced through apparatus 10 by any suitable means such as pin wheels 16 which engage in line holes 17 on the side edges of the web 14. The pin wheels 16 and line holes 17 also maintain the proper synchronization and registration of the web 14 within apparatus 10.

As web 14 is advanced into apparatus 10, it first passes through a numbering station 20. Numbering station 20 includes an adjustable number printer 21 and a vertically reciprocated actuating bar 22 on which printer 21 is mounted. An ink ribbon 23 is advanced along a path beneath the number printer 21 and above web 14, so that when actuating bar 22 is actuated downwardly, it causes printer 21 to strike the ribbon 23 and print web 14 with the number to which printer 21 has been adjusted. Bar 22 is then raised and ribbon 23 advanced for the next printing cycle.

The pin wheels 16, in the preferred embodiment, operate to advance web 14 intermittently, and actuating bar 22 is synchronized therewith to number web 14 when it is stationary. Furthermore, due to the pin wheels 16 and line holes 17, the advancement of web 14 is synchronized so that each time the printer 21 is acutated, it will number the appropriate portion of the preprinted form therebeneath. The pin wheels 16 then advance the web 14 as actuating bar 22 is raised, to position the next form in the proper location beneath printer 21 for printing a number thereon.

Operation of apparatus 10 is under the control of a suitable drive 25 indicated generally by the arrows throughout the drawing figures, and which may be of conventional and well known design. The operation of number printer 21 may also be under the control of a suitable counter (not shown) which counts each actuation of bar 22 and printer 21 according to the number of forms which are to be in each controlled set when the forms are finally shingled. These particular forms constitute a group (of at least two forms each) which all receive the same number. The number printer 21 is adjustable, and after the counter has counted the number of forms which constitute a particular group, it resets and adjusts the number printer 21 to print the next higher number on the forms in the next group. This adjustment may be provided, for example, by using any well known printer which advances each time it receives an electrical or pneumatic pulse. As illustrated in FIG. 1, such a pneumatic pulse could be provided to printer 21 through a connecting hose 24.

Then the pin wheels 16 advance the web of preprinted forms 14 (FIG. 2*b*) past edge trimmers 28 which trim the unwound web 14 to a predetermined width and remove the line holes 17 therefrom. Immediately after edge trimmers 28 is a knife 30 positioned and supported on actuating bar 22 so that when actuating bar 22 is operated (FIG. 2*d*), knife 30 is also operated to separate the numbered forms individually from the web 14. Since knife 30 is carried on actuating bar 22 along with number printer 21, it is also synchronized with the pin wheels 16 to separate the forms 34 when the web is stationary.

The separated forms 34 are then advanced through apparatus 10 (FIGS. 2*e*, 2*a*, and 2*b*) by a transport conveyor 35 onto which the forms 34 are deposited when they are cut and separated by knife 30 from web 14. Conveyor 35 is composed of several parallel belts which transport and advance the individual forms, preferably continuously, to a vacuum transport conveyor 36 located over conveyor 35 and positioned for receiving the separated forms 34 from the transport conveyor. Vacuum transport conveyor 36 is also composed of several individual parallel belts operating in unison. However, the belts of conveyor 36 are perforated and pass beneath corresponding vacuum boxes 37 to grip the forms on the conveyor belts by means of vacuum. The vacuum belts then transport the individual forms on the underside of the vacuum transport conveyor 36 to a shifting location represented by shift plates 40.

Shift plates 40 are attached to an elevator bar 42 on which they are reciprocated upwardly and downwardly. As may be seen in the drawings, the plates 40 move vertically between and through the several belts of the vacuum transport conveyor 36. When moved downwardly (FIG. 2*c*) the shift plates 40 press each form downwardly away from the vacuum belts to break the respective form free from the vacuum and deposit it on a reciprocating slide 50 which is positioned at that moment adjacent the shifting location, to receive the form. Slide 50 has a rear ledge 52 extending up therefrom. Shift plates 40 position the forms 34, one at a time, on slide 50 past ledge 52 so that the ledge can engage the form to propel it forwardly. Elevator bar 42 is then moved upwardly back from slide 50 (FIG. 2*d*) so that the reciprocating slide 50 can advance (FIGS. 2*d* and 2*e*) and also so that another form can be moved by the vacuum transport conveyor 36 to the shifting location (FIG. 2*b*).

When slide 50 propels and advances the form 34 forwardly, it moves past several register stops 55, which in combination a with side registration plate 56 define a predetermined indexing or register position within apparatus 10. The form is removed from slide 50 by first carrying it over the register stops 55 as slide 50 is advanced therepast and ledge 52 propels the sheet over the stops 55. Stops 55 then prevent the sheet from returning with slide 50 as it is reciprocated and returned to the shifting location at shift plates 40, for receiving another form.

To assure accurate indexing of each form, and thus accurate formation of the controlled sets of shingled forms, side and front joggers 57 and 58 are momentarily pressed against the sheet as slide 50 begins to return to the shifting location. The side and front joggers 57 and 58 engage the edges of the form opposite the register stops 55 and side registration plate 56 to press each form firmly against stops 55 and plate 56 for accurate indexing thereof.

Figures 2A, 2B, 2C:
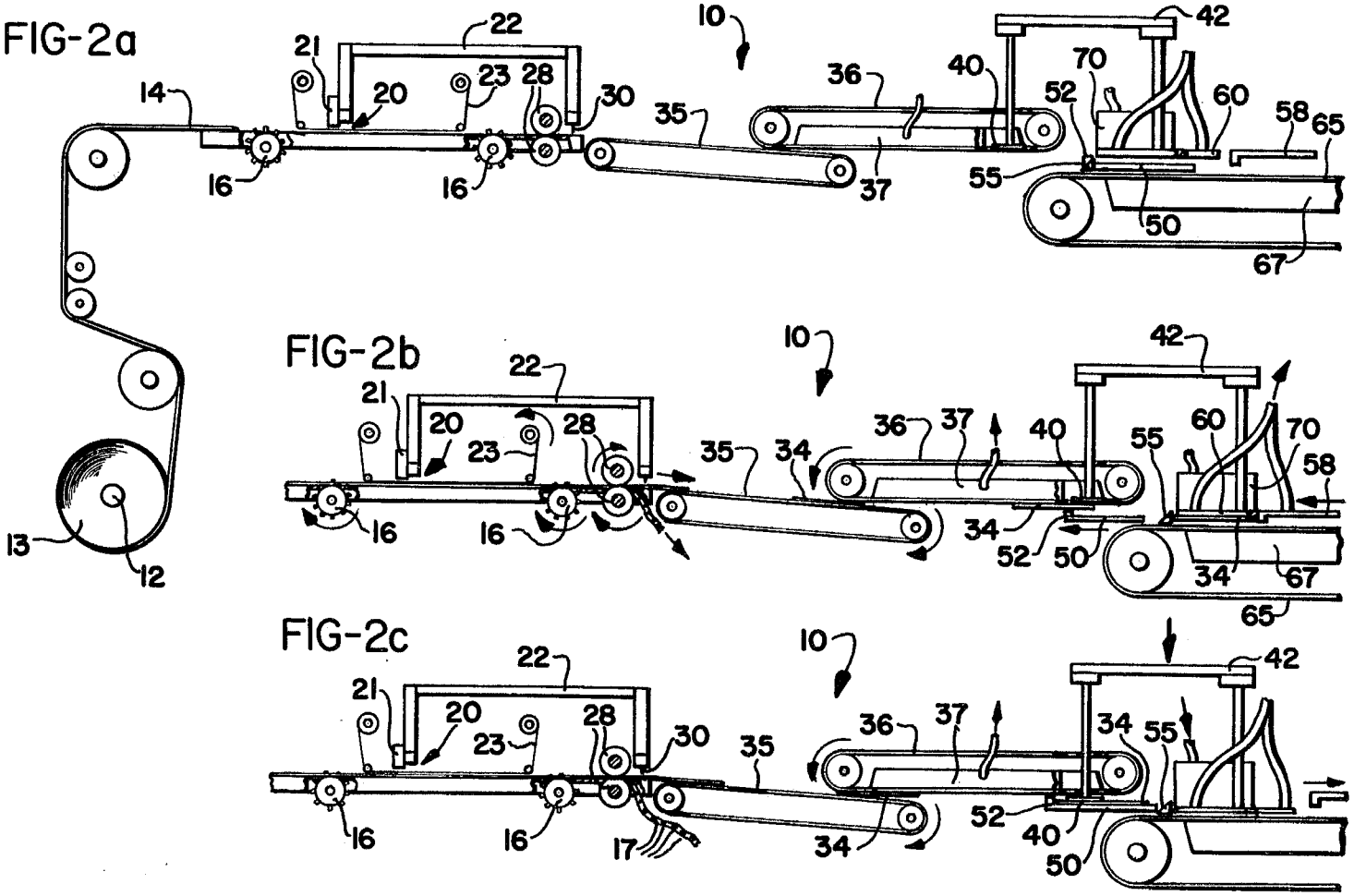
FIG. 2*a* is a diagrammatic side view of the apparatus.
FIGS. 2*b*–2*e* sequentially illustrate a cycle of operation of the apparatus.

A vacuum transfer plate 60 then engages the form in the predetermined indexing position (FIG. 2*e*) and holds it there while slide 50 reciprocates back to the shifting location (FIG. 2*a*). Plate 60 prevents the form from falling haphazardly when slide 50 is withdrawn and no longer supports the form. The vacuum transfer plate 60 then cycles downwardly (FIG. 2*b*) to transfer the sheet accurately into position on a shingling conveyor 65 located therebeneath. In the preferred embodiment, the vacuum transfer plate is also supported on elevator bar 42 and therefore reciprocates vertically along with shift plates 40. Then, when the form is properly positioned on conveyor 65, the vacuum in the vacuum transfer plate 60 is released, depositing the sheet on conveyor 65. Conveyor 65 consists of several belts 65*a* which, as in the vacuum transport conveyor 36, are perforated and pass over vacuum boxes 67 to hold the shingled forms firmly on the shingling conveyor 65.

A gluer 70 is independently reciprocated with the vacuum transfer plate 60 to deposit spots of glue on the top of a side edge of each form (or elsewhere as may be desired) as the form is lowered onto the shingling conveyor 65. This fastens the form directly to one another. Separation of the connected forms into the shingled, overlapped sets, in which each set is composed of the corresponding group of forms which receive indentical numbers from number printer 21, is accomplished by intermittently inhibiting operation of gluer 50 each time the last form of a particular group is deposited on shingling conveyor 65 by the vacuum transfer plate 60. Since those forms receive no glue, the progressing forms on the conveyor are divided into the predetermined shingled sets. In the preferred embodiment, operation of gluer 70 is inihibited simply by preventing it from reciprocating downwardly with vacuum transfer plate 60 when the particular form which is not to be glued is being deposited on shingling conveyor 65.

The shingled, overlapped sets of forms are developed on shingling conveyor 65 by drive 25 which advances conveyor 65 at a predetermined rate, to cause the forms to be shingled in a regular, partially overlapped relation thereon. In the preferred embodiment, conveyor 65 is advanced intermittently by drive 25, in predetermined increments, between the transfers of the forms 34 thereonto. The vacuum boxes 67 are extended to hold the forms on conveyor 65 until the glue sets up. Mechanical coupling between the conveyors and the forms is therefore not required, and the shingled forms may be developed regularly and uniformly on the conveyor in any increments or spacing desired, strictly as a function of the rate at which the conveyor is advanced or incremented. Customized shingling of forms, at any spacings, can therefore be readily and inexpensively provided from a continuous web of forms, within a single unitary apparatus, and without the need for special preparation of the forms or the web itself. The final controlled sets of shingled forms can likewise be free from the line holes 17.

Summarizing the operation of the shingling apparatus 10, FIG. 2*b* shows the web 14 advancing in response to rotation of the pin wheels 16. Actuating bar 22, number printer 21, and knife 30 are elevated. A previously severed form 34 is being advanced on the transport conveyor 35. Another is being advanced by and underneath the vacuum transport conveyor 36. Still another is being positioned in the indexing position by the joggers 57 and 58 as it is held by the vacuum transfer plate 60.

In FIG. 2*c* the web 14 has advanced almost to the point where a form is ready to be cut therefrom. The forms on conveyors 35 and 36 have also advanced, and the reciprocating slide 50 has returned from the intermediate position shown in FIG. 2*b* to the shifting position. Elevator bar 42 has descended to cause shift plates 40 to shift a form down onto slide 50, and also to deposit the form held by vacuum transfer plate 60 onto shingling conveyor 65.

Figure 2D:
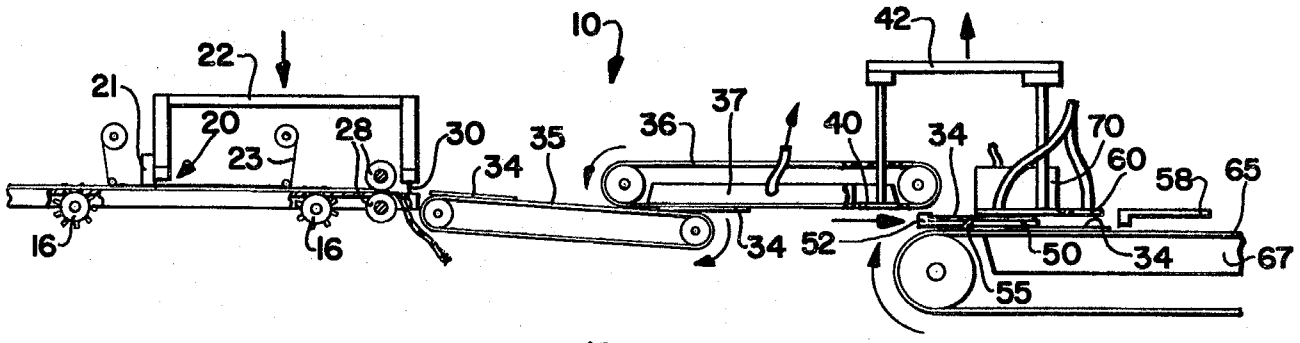

In FIG. 2*d* the actuating bar 22 has descended to cause number printer 21 to print a number on a form on web 14, and simultaneously to cause knife 30 to cut a form from the web. The cut form has begun its advance on transport conveyor 35 while the form which is immediately ahead of it is transferring from transport conveyor 35 to the underside of the vacuum transport conveyor 36. Elevator bar 42 has ascended and the reciprocating slide 50 is moving the form thereon past the register stops 55 on its way to the indexing position.

Figure 2E:
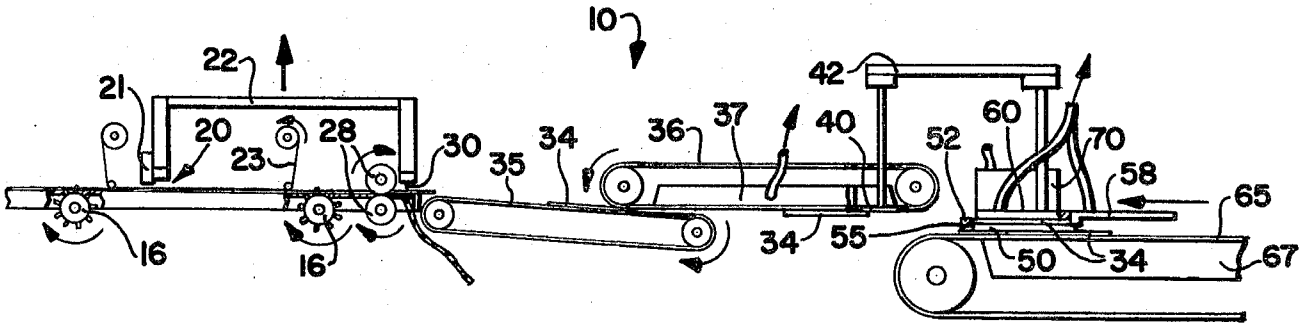

Finally, in FIG. 2*e* the cycle of operation has returned almost to that shown in FIG. 2*b*. The actuating bar 22 is elevated; pin wheels 16 are advancing web 14; the next forms in this sequence are advancing on conveyors 35 and 36; and the side joggers 57 and 58 are about to position a form accurately in the indexing position.

It will be appreciated, of course, that the precise phase relationships of the various machine components may differ somewhat from that shown in these drawing figures. The particular phase relationships chosen will depend on such variables as the length of the forms being shingled, the relative operating speeds of the various machine components (e.g. belts 35 and 36 vis-a-vis pin wheels 16), and so forth.

As may be seen, therefore, the present invention has numerous advantages. It is versatile but inexpensive and uncomplicated in its design and operation. A wide variety of sizes and types of forms can readily and quickly be numbered, assembled, and shingled into the controlled sets. Overall, the invention provides for a substantially greater efficiency in the production of such sets. The printing press can be operated at maximum speed by rewinding the printed forms directly onto a roll as a continuous web, rather than having to go into a sheeter. The printing press prepares the forms without numbers, and proper numbering, grouping and shingling of the forms is subsequently provided by the present invention, in a single process, when the continuous web of forms is numbered and shingled therein.

While the form of apparatus for carrying this method into effect constitutes a preferred embodiment of the invention, it is to be understood that the invention is not limited to this precise form of apparatus, and that changes may be made without departing from the scope of the invention.

What is claimed is:

1. A unitary apparatus for processing a roll of a continuous web of forms into controlled sets of shingled forms, comprising:

(a) unwinding and advancing means for holding a roll of the web and unwinding and advancing the web from the roll, (b) numbering means for receiving the web as it is advanced, numbering the forms in groups of predetermined count of at least two forms each, giving the forms in each group related numbers, and numbering the forms in consecutive groups consecutively, (c) cutting means receiving the web and separating the numbered forms individually from the web, (d) fastening means for securing together the separated individual forms of each group into separate, shingled, overlapped sets, (e) said fastening means including a predetermined indexing position in said apparatus, (f) conveyor means for receiving the separated forms from the cutting means and transporting them to a predetermined shifting location, (g) means for transferring the separated forms individually from the shifting location to the indexing position, and (h) shifting means for removing the forms from said conveyor and depositing them on said transferring means.

2. The apparatus of claim 1 wherein said cutting means further comprises:

(a) edge trimmers positioned and operable for trimming the unwound web to a predetermined width, and (b) a knife positioned and operable for separating the numbered forms individually from the web.

3. The apparatus of claim 1 or 2 wherein said fastening means further comprises shingling means for receiving said forms at said indexing position and forming them into said shingled sets.

4. The apparatus of claim 3 wherein said shingling means further comprises:

(a) a shingling conveyor adjacent said predetermined indexing position, (b) transfer means for receiving each form individually at said predetermined position and transferring each said form accurately onto said shingling conveyor, (c) shingling conveyor advancing means for advancing said shingling conveyor at a predetermined rate to cause said forms to be shingled in a regular, partially overlapped relation thereon, and (d) gluing means for fastening said forms into said sets in such shingled, overlapped relation.

5. The apparatus of claim 1 wherein said numbering means further comprises:

(a) an adjustable number printer, (b) adjustment means for adjusting said number printer to print a predetermined number for each said group of forms, and, after all the forms in a given group have received said related numbers, for adjusting said number printer to print the next number on all the forms in the next group, and (c) actuating means for supporting said number printer adjacent said web and for actuating said number printer to print said predetermined number on each form of each said group.

6. The apparatus of claim 1 wherein said advancing means advances the web intermittently, and wherein said numbering and cutting means are synchronized with said advancing means to number and separate the forms when the web is stationary.

7. The apparatus of claim 1 wherein said conveyor means further comprises:

(a) a first transport conveyor positioned for receiving the separated forms as they are separated from the web, (b) a vacuum transport conveyor positioned above at least a portion of said first transport conveyor and having an underside capable of conveying the forms which is located at a height sufficient to permit the separated forms from said first transport conveyor to be transferred to said underside to be conveyed to the predetermined shifting location.

8. The apparatus of claim 1 wherein said shift plate further comprises a plurality of plates vertically movable between and through the belts of said vacuum transport conveyor for pressing the forms downwardly away from said underside to break them free from the vacuum and deposit them on said reciprocating slide.

9. A unitary apparatus for processing a roll of a continuous web of forms into controlled sets of shingled forms, comprising:

(a) unwinding and intermittent advancing means for holding and unwinding a roll of the web, and advancing the web intermittently from the roll, (b) numbering means synchronized with said advancing means, including an adjustable number printer, and including means for receiving the web as it is advanced, then numbering the forms individually when stationary into groups of predetermined count of at least two forms each, giving the forms in each group identical numbers, and numbering the forms in consecutive groups consecutively, (c) adjustment means forming a part of said numbering means for adjusting said number printer to print a predetermined number for each said group of forms, and, after all the forms in a given group have been identically numbered, for adjusting said number printer to print the next higher number on all the forms in the next group, (d) actuating means forming a part of said numbering means for supporting said number printer adjacent said web and for actuating said number printer to print said predetermined number on each form of each said group, (e) cutting means synchronized with said advancing means for separating the numbered forms individually from the web when the web is stationary, said cutting means including edge trimmers positioned and operable for trimming the unwound web to a predetermined width, and a knife positioned and operable for separating the numbered forms individually from the web, (f) register stop means defining a predetermined indexing position in said apparatus, (g) a first transport conveyor positioned for receiving the separated forms as they are separated from the web, (h) a vacuum transport conveyor positioned above at least a portion of said first transport conveyor and having an underside capable of conveying the forms which is located at a height sufficient to permit the separated forms from said first transport conveyor to be transferred to said underside to be conveyed to a predetermined shifting location, (i) a reciprocating slide operably movable back and forth between positions adjacent said shifting location and said indexing position, for receiving a form individually at said shifting location, advancing it to and positioning it in said indexing position in edge abutting relation with said register stop means, and causing said register stop means to retain each such form at said indexing position upon return of said slide to said shifting location, (j) shift plate means operable at said shifting location for shifting said forms from said vacuum transport conveyor onto said reciprocating slide, said shift plate means including a plurality of plates vertically movable between and through the belts of said vacuum transport conveyor for pressing the forms downwardly away therefrom to break them free from the vacuum and deposit them on said reciprocating slide, (k) a shingling conveyor adjacent said predetermined indexing position, (l) vacuum transfer plate means for receiving each form individually at said predetermined indexing position and transferring each said form accurately onto said shingling conveyor, (m) shingling conveyor advancing means for advancing said shingling conveyor at a predetermined rate to cause said forms to be shingled in a regular, partially overlapped relation thereon, and (n) gluing means for fastening the forms of each said group into shingled, overlapped sets.

10. The apparatus of claim 7 wherein said transferring means comprises a reciprocating slide operably movable back and forth between positions adjacent said shifting location and said indexing position, for receiving a form at said shifting location, and advancing it to and positioning it in said indexing position.

11. The apparatus of claim 7 wherein said shifting means comprises a shift plate operable at said shifting location for shifting said forms from said vacuum transport conveyor onto said reciprocating slide.

* * * * *